United States Patent [19]

Holdsworth et al.

[11] Patent Number: 4,848,458

[45] Date of Patent: Jul. 18, 1989

[54] LOCKABLE WELL CAP

[75] Inventors: Thomas S. Holdsworth; George M. Holdsworth, both of West Des Moines, Iowa

[73] Assignee: Kamkap, Inc., Des Moines, Iowa

[21] Appl. No.: 252,129

[22] Filed: Oct. 3, 1988

[51] Int. Cl.[4] ..... E21B 33/02; F16L 55/10

[52] U.S. Cl. ..... 166/92; 166/93; 166/94; 138/89; 285/901

[58] Field of Search ..... 166/92, 93, 94, 97, 166/75.1, 79; 138/89; 285/901

[56] References Cited

U.S. PATENT DOCUMENTS

| | | | |
|---|---|---|---|
| 2,179,191 | 11/1939 | McWilliams | 166/14 |
| 2,784,988 | 3/1957 | Banchback | 285/140 |
| 2,835,327 | 5/1958 | Bartlett | 166/75.1 |
| 3,625,282 | 12/1971 | Bridges et al. | 166/75 |
| 3,672,403 | 6/1972 | Wilson et al. | 138/89 |
| 3,722,549 | 3/1973 | Wilson et al. | 138/89 |
| 3,949,787 | 4/1976 | Milo | 138/89 |
| 4,014,367 | 3/1977 | Milo | 138/89 |
| 4,254,801 | 3/1981 | Gerthoffer et al. | 138/89 |

FOREIGN PATENT DOCUMENTS

| | | | |
|---|---|---|---|
| 867188 | 12/1952 | Fed. Rep. of Germany | 138/89 |

*Primary Examiner*—Jerome W. Massie
*Assistant Examiner*—Terry Lee Melius
*Attorney, Agent, or Firm*—Henderson & Sturm

[57] ABSTRACT

A lockable well cap for capping the upper end of a well casing. A base member, which has an upwardly and inwardly interior surface with tapered upwardly directed serrations formed thereon, frictionally engages a portion of the well casing. The outside surface of the base member has a lock tab which aligns with a lock tab on the cover to receive a locking padlock. The cover also includes pins which contact inclined grooves in the base member when properly engaged. A first fluid impervious gasket is seated between the well casing and the base member, and a second fluid impervious gasket is seated between the base member and the cover, both to provide a watertight and waterproof seal.

10 Claims, 1 Drawing Sheet

LOCKABLE WELL CAP

TECHNICAL FIELD

This invention relates to caps for pipes, and more particularly to lockable well caps.

BACKGROUND ART

Numerous devices are known for capping the end of a pipe. None of these devices, however, are suitable for use as a protective cover for monitor, sniffer and/or recovery wells. These wells, when properly installed, require a waterproof and watertight cap to aid in sealing off any surface run-off and potential contamination. A watertight and weatherproof cap is essential in maintaining the integrity of an aquafer of interest during the monitoring process. No known cap provides a lockable, watertight, and weatherproof seal.

Also, in the monitoring well industry, the well casing is often cut with a hand saw. This procedure results in an uneven and often jagged finish on the top of the well casing. No known well cap will provide a watertight and weatherproof seal at the top of the well casing when the finish is uneven and jagged.

Those concerned with these and other problems recognize the need for an improved lockable well cap.

DISCLOSURE OF THE INVENTION

The present invention provides a lockable well cap for capping the upper end of a well casing. A base member, which has an upwardly and inwardly interior surface with tapered upwardly directed serrations formed thereon, frictionally engages a portion of the well casing. The outside surface of the base member has a lock tab which aligns with a lock tab on the cover to receive a locking padlock. The cover also includes pins which contact inclined grooves in the base member when properly engaged. A first fluid impervious gasket is seated between the well casing and the base member, and a second fluid impervious gasket is seated between the base member and the cover, both to provide a watertight and waterproof seal.

An object of the present invention is the provision of an improved lockable well cap that is easy to install.

Another object of the present invention is to provide a lockable well cap that will provide a watertight and waterproof seal to avoid contaminants from entering the well.

A further object of the invention is the provision of a lockable well cap that will provide a watertight and waterproof seal on the jagged cut top edge of a well casing.

Still another object of the present invention is to provide a lockable well cap that allows for easy access to the locking padlock.

A still further object of the present invention is the provision of a lockable well cap that is inexpensive to manufacture.

BRIEF DESCRIPTION OF THE DRAWINGS

These and other attributes of the invention will become more clear upon thorough study of the following description of the best mode for carrying out the invention, particularly when reviewed in conjunction with the drawings, wherein.

BEST MODE FOR CARRYING OUT THE INVENTION

Figure 1:
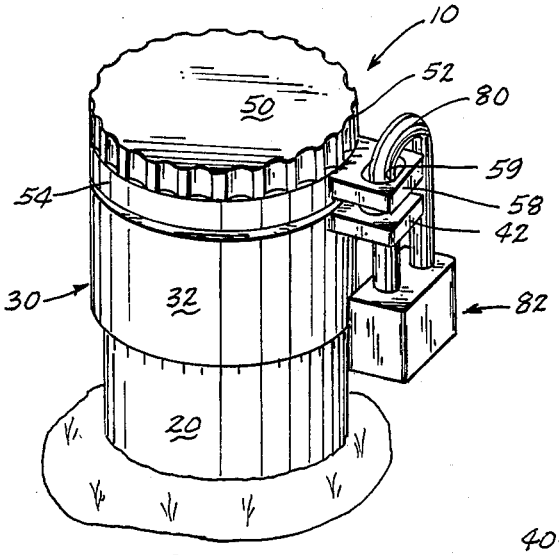
FIG. 1 is a perspective view of the lockable well cap of the present invention shown in the fully installed and padlocked position.

Referring now to the drawings, wherein like reference numerals designate identical or corresponding parts throughout the several views, FIG. 1 shows the lockable well cap (10) of the present invention. The lockable well cap (10) is designed to cap the upper end of a well casing (20). The well casing (20) may be formed of various materials including unthreaded PVC plastic pipe having an uneven jagged upper edge (22).

Figure 2:
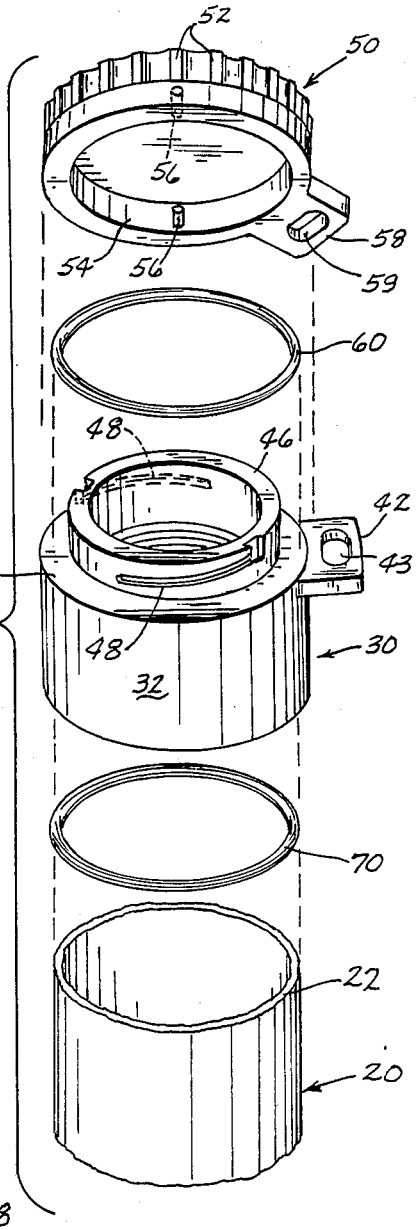
FIG. 2 is an exploded perspective view of the lockable well cap showing the well casing, the base member, the cover and the sealing gaskets and the relative positions thereof.
Figure 3:
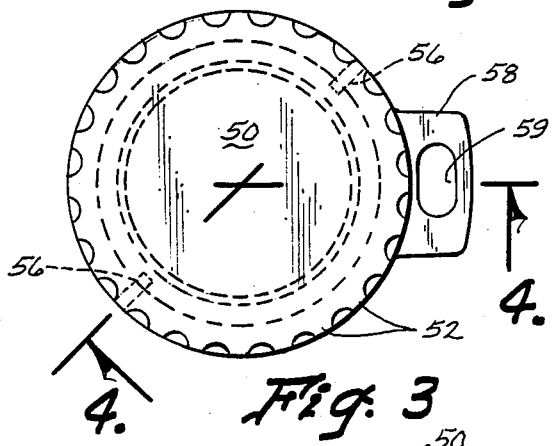
FIG. 3 is a top plan view of the lockable well cap.
Figure 4:
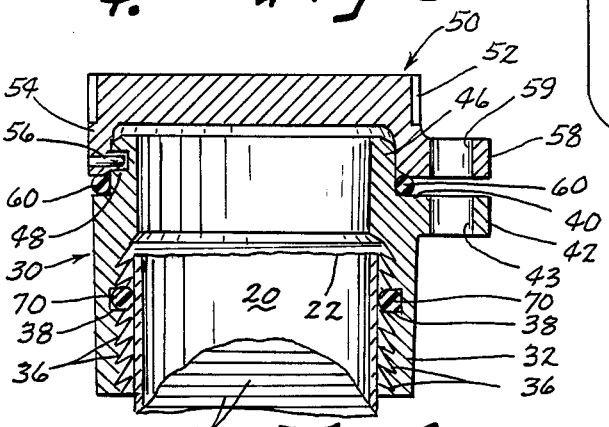
FIG. 4 is a side elevation sectional view of the lockable well cap taken along line 4—4 in FIG. 3.

As best shown in FIGS. 2 and 4, the well cap (10) includes a base member (30), a cover (50), and O-rings (60 and 70). The base member (30) includes a body section (32) that is formed of an open cylinder. The body section (32) has an interior surface that is upwardly and inwardly tapered to frictionally receive the upper end of a well casing (20). A number of axially spaced rings (34) are milled into the interior surface and include upwardly directed pointed edges (36) that form serrations to secure the base member (30) in position. An annular seat (38) is also milled into the interior surface to receive an O-ring (70).

The exterior surface of the body section (32) includes an annular shoulder (40) and a radially extending first lock tab (42) having an oblong opening (43). A lip (46) extends up from the shoulder (40) and carries a pair of inclined grooves (48).

The cover (50) includes a knurled rim (52) and a downwardly extending flange (54) that carries a pair of radially extending pins (56) on its interior surface. A second lock tab (58) extends radially outward from the flange (54) and has an oblong opening (59). An O-ring (60) is used to provide a sealed connection between the base member (30) and the cover (50). The O-rings (60 and 70) are fluid impervious gaskets having a circular cross section. It is to be understood that the O-rings (60 and 70) may be formed of various suitable materials including rubber, neoprene, nylon and Teflon.

In use, the first O-ring (70) is positioned in the annular seat (38) in the interior surface of the body section (32). The base member (30) is then positioned over the upper end of the well casing (20) and a hammer or mallet is used to force the tapered interior surface of the base member (30) down on the well casing (20). The interior surface is sized such that the upper edge (22) of the unthreaded well casing (20) will be disposed above the O-ring (70) when the base member (30) is in the full down position. The O-ring (70) thus provides a seal between the exterior sidewall of the well casing (20) and the interior surface of the body section (32). The upwardly directed pointed edges (36) of the rings (34) prevent removal of the base member (30) once it is securely attached to the well casing (20).

With the base member (30) secured in position, the second O-ring (60) is positioned to rest on the horizontal shoulder (40) adjcent the vertical lip (46). The cover (50) is then positioned so that the pins (56) align with the top of the inclined slots (48). By turning the cover (50) about 90 degrees, or one-quarter turn, the cover (50) compresses the second O-ring (60) to provide a seal between the base member (30) and the cover (50), and simultaneously aligns the openings (43 and 59) in the first and second lock tabs (42 and 58). The link (80) of a padlock (82) is then inserted through the openings (43 and 59) and the padlock (82) is closed. Since the oblong openings (43 and 59) are larger than the link (80) of the padlock (82), the padlock (82) may be rotated and inverted to provide convenient access to the keyway when the access to the area surrounding the lockable well cap (10) is limited.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

We claim:

1. A lockable well cap for capping the upper end of a well casing, said well cap comprising:

a base member including a body section having an interior surface and an exterior surface;

said interior surface being upwardly and inwardly tapered and having upwardly directed serrations formed thereon and an annular seat formed therein, a portion of said tapered interior surface being disposed to frictionally engage a portion of said well casing;

said exterior surface including an upper portion having an annular shoulder, a first lock tab extending radially from said shoulder and having an opening therein to receive the link of a padlock, and a lip extending upwardly from said shoulder and having inclined grooves formed therein;

a cover selectively movable between an engaged position and a disengaged position, said cover including a downwardly extending flange carrying pins disposed to selectively engage the inclined grooves, and having a radially extending second lock tab with an opening therein disposed to align with the opening in said first lock tab when said cover is in the engaged position;

a first fluid impervious gasket disposed in said annular seat to sealingly connect said well casing and said base member; and a second fluid impervious gasket disposed on said shoulder to sealingly connect said base member and said cover when said cover is in the engaged position.

2. The invention of claim 1 wherein a plurality of axially spaced rings form said upwardly directed serrations.

3. The invention of claim 1 wherein the openings in said first and second lock tabs are larger than the link of the padlock, thereby allowing the link to move freely within the openings to allow the padlock to be inverted for easy access to a keyway.

4. The invention of claim 1 wherein said cover includes a knurled rim.

5. The invention of claim 1 wherein said first fluid impervious gasket is an O-ring.

6. The invention of claim 1 wherein said second fluid impervious gasket is an O-ring.

7. The invention of claim 5 wherein said O-ring is circular in cross-section.

8. The invention of claim 6 wherein said O-ring is circular in cross section.

9. The invention of claim 1 wherein said well casing is formed of unthreaded plastic pipe.

10. The invention of claim 9 wherein said plastic pipe is PVC.

* * * * *